United States Patent [19]

Pinquist

[11] Patent Number: 4,905,952

[45] Date of Patent: Mar. 6, 1990

[54] LOCKING SKIRT FOR CHANNEL-BEAM CLAMP

[75] Inventor: Alex Pinquist, Woodmere, N.Y.

[73] Assignee: Pinquist Tool & Die Co., Inc., Brooklyn, N.Y.

[21] Appl. No.: 119,521

[22] Filed: Nov. 12, 1987

[51] Int. Cl.[4] ..... E04B 5/52

[52] U.S. Cl. ..... 248/317; 52/484; 24/537

[58] Field of Search ..... 248/62, 222.1, 228, 248/317; 24/556, 537; 52/484, 485

[56] References Cited

U.S. PATENT DOCUMENTS

| | | | |
|---|---|---|---|
| 1,585,840 | 5/1926 | Fahnestock | 248/74.2 X |
| 3,558,091 | 1/1971 | Bush | 248/317 |
| 3,599,921 | 8/1971 | Cumber | 248/317 |
| 3,608,857 | 9/1971 | Hibbeler | 248/317 |
| 4,545,166 | 10/1985 | Kielmeyer | 52/484 |
| 4,692,969 | 9/1987 | Johnson | 24/573 |
| 4,700,917 | 10/1987 | Dillman | 248/228 |
| 4,723,749 | 2/1988 | Carraro | 248/317 |

FOREIGN PATENT DOCUMENTS

| | | | |
|---|---|---|---|
| 228182 | 6/1958 | Australia | 52/484 |
| 237613 | 3/1960 | Australia | 24/537 |
| 250558 | 12/1963 | Australia | 52/484 |
| 1177311 | 9/1964 | Fed. Rep. of Germany | 52/484 |
| 2809674 | 12/1979 | Fed. Rep. of Germany | 52/484 |
| 1403744 | 5/1965 | France | 248/317 |

*Primary Examiner*—Ramon O. Ramirez

*Assistant Examiner*—Robert A. Olson

*Attorney, Agent, or Firm*—Klein & Vibber

[57] ABSTRACT

An improved channel beam clamp and locking skirt assembly for a suspended ceiling grid system. The channel beam clamp has a recess for receiving a channel of the ceiling grid system. The channel beam clamp is suspended from the channel in an essentially vertical plane. The channel beam clamp has a plurality of prongs extending from the lower end thereof. Each of these groups has an inwardly curved portion at its lower end which bulge outwardly from the vertical plane so that a pair of opposite prongs of the plurality of prongs define a receiving space therebetween for receiving a bulb of a ceiling grid member of the ceiling grid system. The assembly includes an inverted essentially U-shaped locking skirt which has a pair of legs depending from a slotted horizontal base. The lower end of the channel beam clamp with its plurality of prongs is slid through the slot and the channel beam clamp is slid upwardly. The plurality of prongs can again spread apart after they have passed through the slot. The bulb of the ceiling grid system is then introduced into the receiving space between the plurality of prongs so as to press them toward each other and to clamp the bulb therebetween. A first leg of the pair of legs of the locking skirt has an inwardly bent portion which extends underneath and lower edge of at least one of the prongs and thereby inhibits an upward sliding movement of the locking skirt along the channel-beam clamp after assembly.

6 Claims, 4 Drawing Sheets

LOCKING SKIRT FOR CHANNEL-BEAM CLAMP

BACKGROUND OF THE INVENTION

This invention relates to suspended ceiling systems, and in particular the standard suspended acoustic ceiling systems manufactured in accordance with Article 5 and Reference Standard RS5 of the Building Code of the City of New York.

Such suspended acoustic ceiling systems generally include a channel-beam clamp for suspending the support members of a suspended ceiling grid system from a series of "black channels". Such suspended ceiling systems are generally supported and suspended from upper elements ("black channels") in the building structure. Conventionally, these grid systems can also be suspended from wires. However, the Building Codes of some jurisdictions, in particular the Building Codes of New York City prohibit the use of wires and require the use of channel beam clamps and locking skirts which are positioned about 4 feet apart.

The ceiling grid systems are supported from these "black channels" by the coaction of a channel-beam clamp and a locking skirt.

SUMMARY OF THE INVENTION

It is an object of the invention to provide a novel locking skirt which coacts with a suspended channel-beam clamp to provide a more secure, safe, strong and easily and quickly assemblable combination of channel-beam clamp and locking skirt.

The objects of this invention are accomplished by providing an improved locking skirt which hooks more easily over the clamping prongs of the channel-beam clamp and the bulb of the ceiling grid system and is more securely locked thereon so that the possibility of the locking skirt riding up on the channel-beam clamp is reduced.

BRIEF DESCRIPTION OF THE DRAWINGS

With these and other objects in view, which will become apparent in the following detailed description, the present invention, which is shown by example only, will be clearly understood in connection with the accompanying drawing, in which.

DESCRIPTION OF THE PREFERRED EMBODIMENT

Figure 1:
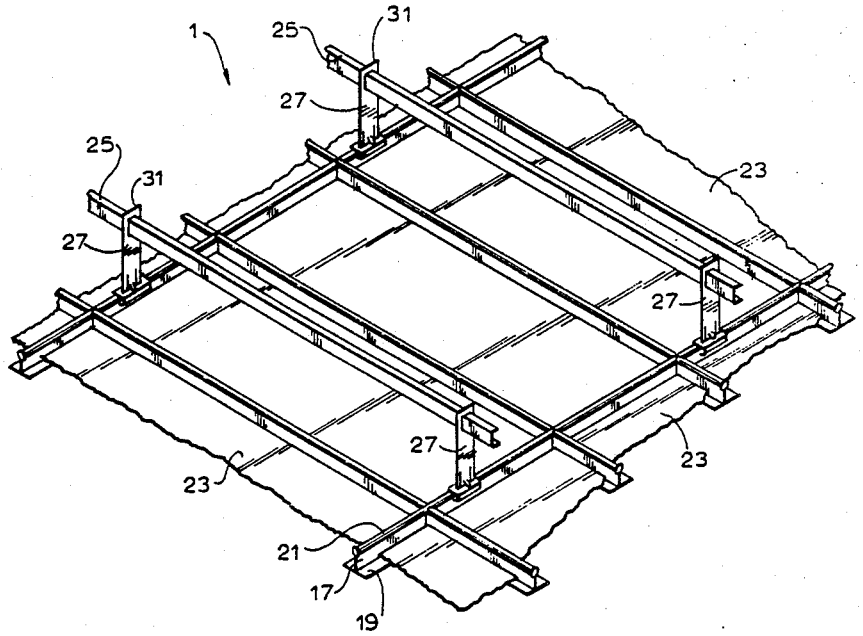
FIG. 1 is a fragmentary perspective view of the part of a acoustic ceiling grid structure showing the supporting channels and channel-beam clamps attaching the "black channels" to the members of the ceiling grid system.

Referring now to the drawings, and in particular to FIG. 1, there is illustrated in perspective a conventional suspended acoustic ceiling system 1 which includes a plurality of interlocking main beams or members 13 and cross members 15. Each of the main and cross members 13, 15 have a vertical fin 17 (see FIG. 2), outwardly projecting horizontal flanges 19 at the bottom of the fin 17, and a bulb 21 at the top of the fin 17. Such a suspended acoustic ceiling system is well-known and is, for example, described in the U.S. Pat. No. 3,558,091.

Figure 2:
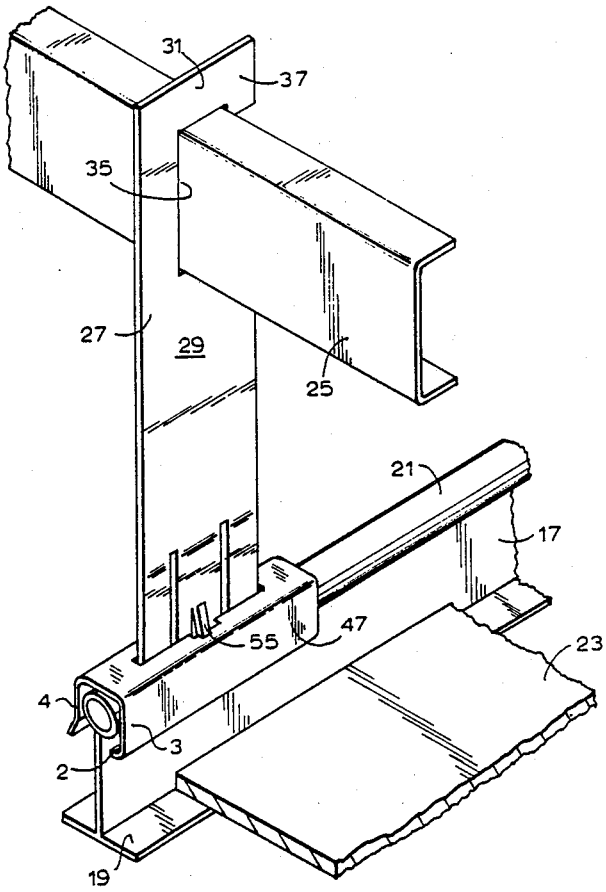
FIG. 2 is a fragmentary perspective view of the assembly of the "black channels", channel-beam clamp, locking skirt and bulb.
Figure 3:
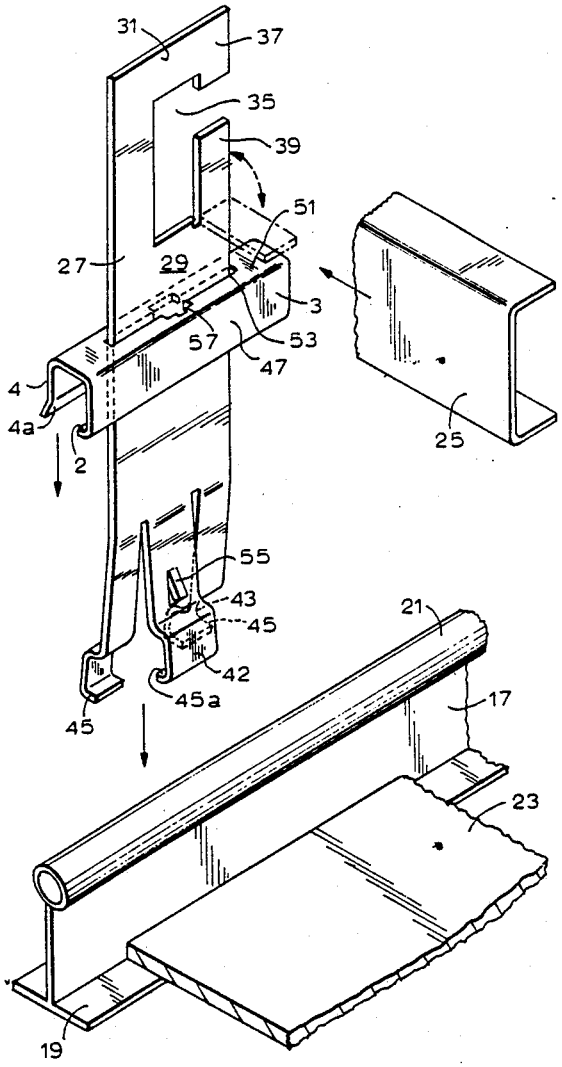
FIG. 3 is an exploded fragmentary perspective view of the assembly shown in FIG. 2.
Figure 4:
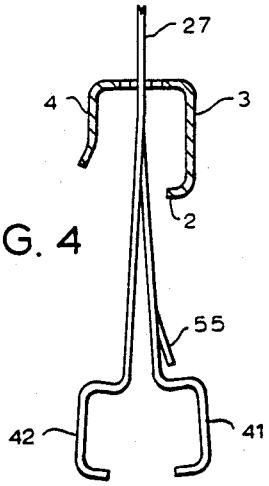
FIGS. 4 to 7 are schematic side elevational views of the assembly of a channel-beam clamp, locking skirt and bulb in various stages of assembly.
Figure 5:
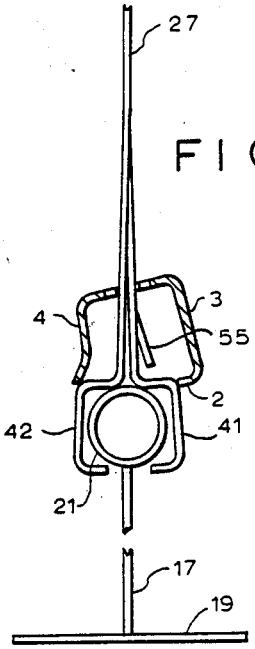
Figure 6:
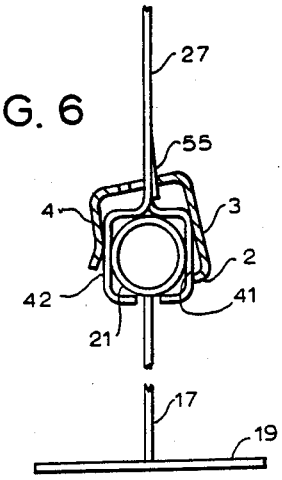
Figure 7:
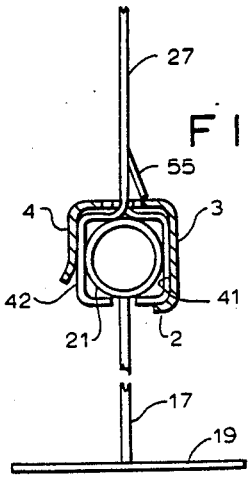

FIGS. 2 and 3 show in perspective views the assembly of the vertical fin 17 with the channel-beam clamp 27. This assembly is effected by means of the novel locking skirt 47 of this invention. The novel locking skirt 47 of this invention distinguishes itself from the locking skirt of the state of the art in that it greatly facilitates the assembly of locking skirt, channel-beam clamp and bulb. Moreover, once the assembly has been effected, the locking skirt 47 is much more securely mounted on the channel-beam clamp 27 and therefore less likely to ride up on said channel-beam clamp 27. The ease of assembling the locking skirt and channel-beam clamp is schematically illustrated in FIGS. 4 to 7.

Each bulb 21, shown in FIGS. 2–7, can be round, but may be square, rectangular, or any other suitable configuration.

The horizontal flanges 19 of the grid members 13, 15 support in a conventional manner the ceiling tiles 23 and the grid members 13, 15 are in turn supported from a series of "black channels" 25 by means of a plurality of conventional channel beam clamps 27.

The conventional channel-beam clamps 27 generally comprise a C-shaped body member having an upright portion 29 with a top portion 31 and a bottom portion 33 extending therefrom to define a channel-receiving notch 35. A top tab 37 extends extends downwardly from the end of top portion 31 and is adapted to hook over the "black channel" 25. A locking tab 39 extends horizontally from bottom portion 33 prior to the insertion of the channel 25 and is adapted to be bent into a vertical position to lock the channel-beam clamp 27 around the channel 25.

The conventional channel-beams clamp 27 has at its lower end three outwardly bulging prongs, two of which form the exterior prongs 41, 43 and prong 42 is the inner somewhat wider one. Each one of the three prongs has a lower inwardly bent portion 33 so that the two outer prongs 41 and 43 have inwardly bent curved jaws 45 which confront an oppositely curved jaw **45*a* on the middle prong 42**.

Moreover, the middle prong 42 also has, slightly above its prong, a locking lance 55 which can be either punched or cut into the channel-beam clamp which is preferably made of sheet metal. The locking skirt 47 is also preferably made of sheet metal. Other materials such as spring steel, fire resistant plastic materials, etc. can also be used.

The aforedescribed suspended acoustic ceiling system is conventional and well-known in the art with the exception of the locking skirt 47 which forms the subject of this invention.

This locking skirt 47 is formed by a channel member which has a pair of legs 3 and 4 and a base 51. When the locking skirt is fully assembled on the ceiling beam channel, it assumes a position wherein the base 51 is disposed in a generally horizontal plane and the pair of legs 3 and 4 extend downwardly from this horizontal base 51. The base 51 has the conventional centrally, longitudinally extending slot 53 with a large central portion 57. This central longitudinal slot 53 is sufficiently large to permit the passage therethrough of the channel-beam clamp 27. In order to pass the lower portion of the channel-beam clamp 27 through the slot 53 prongs 41–43 have to be biased inwardly. Once these prongs pass through the slot 53 they snap back into their original spread apart position (see FIG. 3) due to the elasticity of the sheet metal forming the channel-beam clamp 27. The channel-beam clamp 27 is hooked over the conventional black channel member 25 by inserting it into the channel-receiving recess 35. The lower bent tab 39 is then bent into a vertical plane corresponding to the remainder of the plane of channel-beam clamp 27 thereby securely locking the channel-beam clamp 27 onto the black channel member 25 (FIG. 3). The prongs 41–43 on the bottom of the channel-beam clamp member 27 are shaped so as to receive the bulb 21 of the main beam members 13, 15 (FIG. 2). After the prongs 41–43 of the channel-beam clamp 27 have enveloped the bulb 21, the locking skirt 47 of this invention is lowered in a manner illustrated in FIGS. 4 to 7 until the locking skirt 47 passes over the locking lance 55 (see FIG. 7). In this position, the prongs 41–43 are fully enveloped by the locking slide 47 and this locking slide 47 is prevented from riding up on the ceiling-beam clamp 27 by the locking lance 55 as well as by the inwardly bent jaw 2 of the locking slide 47.

It is in this respect that the locking slide 47 of this invention forms a significant improvement over the conventional locking slide of the state of the art. In the conventional locking slide, the upward sliding movement of the locking slide is only prevented by the locking lance 55. This locking lance 55 has proven to be unreliable in the past and the locking slide 47 frequently rode up on the channel-beam clamp 27 which in turn caused the complete disassembly between the bulb 21 and the channel-beam clamp 27 and a failure of the entire suspension system.

The locking slide 47 of this invention provides an additional safety feature. The new slide has the longitudinal conventional slot 53 on the base 51 which is similar to that of the conventional locking slide. Moreover, the base 51 of the locking slide 47 of this invention corresponds essentially in size to that of the conventional known locking slide of the state of the art. However, the locking slide 51 of this invention has one leg 3 that is slightly longer than the other leg 4. The leg 4, while being slightly shorter than a conventional locking skirt has essentially the same width than that of the conventional locking slide, has an outwardly bent lip **4*a* at its bottom edge. The other leg 3 is slightly longer than that of a conventional locking slide so that it may be slid past the bottom edges of the prongs 41–43 after having been fully lowered over the channel-beams clamp 27 and then moves a sufficient distance automatically (into alignment) so that the lower inwardly bent lip 2 seats underneath the jaws 45, 45*a* of the prongs 41–43, due to the mating shapes of the prongs 41–43 and the locking slide 47 so as to prevent an upward sliding movement of the locking slide 47 over the prongs 41–43. The inwardly bent portion 2 of the leg 3** is generally approximately ⅛ of an inch in width.

MANNER OF ASSEMBLY

Referring now to Figures to 7, as can be noted the locking skirt 47 is lowered over the channel-beam clamp 27 so that the longer leg 3 first rides over the outwardly bulging prongs 41–43 of the channel-beam clamp 27. Although the outwardly bent portion **4*a* is canted away from the plane of the leg 4, this bent portion forming the curled lip 4*a* of the shorter leg 4 of the locking slide 27 is slid over the other outer surface of the three prongs 41–43 which are disposed at the lower end of the channel-beam clamp 27 and this outwardly curved lip 4*a* facilitates such sliding movement. Finally, the locking slide passes over the protrusions of the prongs 41–43 of the channel-beam clamp 27 and the longer leg 3 slides over the outwardly bulging prongs 41–43 and finally comes to rest in a fully assembled mating condition (See FIG. 7). At this time, the locking slide is securely mounted and the lip is seated against the jaws 45 or 45*a*, so as to remain in place even when a poorly formed locking lance 55** is present.

Consequently, the novel locking slide of this invention provides for a more secure assembly of a suspended acoustic ceiling system.

Although variations of an embodiment of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

In the claims:

1. In a suspended ceiling grid system, an improved channel beam clamp and locking skirt assembly wherein the channel beam clamp has a recess for receiving a channel of the ceiling grid system so as to be suspended therefrom, said channel beam clamp when so suspended is disposed in an essentially vertical plane, said channel beam clamp has a plurality of prongs extending from the lower end therefrom, each prong has a curved portion at its lower end which bulges outwardly from said vertical plane so that a pair of opposite prongs of said plurality of prongs define a receiving space therebetween for receiving a bulb of a ceiling grid member of said ceiling grid system, an inverted essentially U-shaped locking skirt having a pair of legs depending from a slotted horizontal base, said plurality of prongs being slid through said slotted base when said locking skirt is slid upwardly on said channel-beam clamp forming an assembly system to permit a spreading apart of said pair of opposite prongs, said bulb of said ceiling grid system is then introduced into said receiving space and said locking skirt is slid downwardly over said curved portions of said plurality of prongs so as to press them toward each other and to clamp said bulb therebetween, a first leg of said pair of legs of said locking skirt having an inwardly bent portion which seats underneath the lower edge of at least one of said prongs and thereby inhibits an upward sliding movement of said locking skirt along said channel-beam clamp after assembly.

2. In a suspended ceiling system, the improved channel-beam clamp and locking skirt assembly as set forth in claim 1, wherein a second leg of said pair of legs of said locking skirt is slightly shorter than said first leg.

3. In a suspended ceiling system, the improved channel-beam clamp and locking skirt assembly as set forth in claim 2, wherein said second shorter leg has an outwardly bent portion at its bottom edge.

4. In a suspended ceiling system, the improved channel-beam clamp and locking skirt assembly as set forth in claim 2, wherein said inwardly bent portion extends from said first leg at an angle of about 90°.

5. In a suspended ceiling system, the improved channel-beam clamp and locking skirt assembly as set forth in claim 1, wherein at least one of said plurality of prongs has a lance for inhibiting upward movement of said locking skirt along said channel-beam clamp after assembly of the channel-beam clamp, locking skirt and bulb of a ceiling grid member.

6. In a suspended ceiling system, the improved channel-beam clamp and locking skirt assembly as set forth in claim 1, wherein said channel-beam clamp and locking skirt are made of sheet metal.

* * * * *